US006359528B1

(12) United States Patent
Dao

(10) Patent No.: US 6,359,528 B1
(45) Date of Patent: Mar. 19, 2002

(54) SPACE-OPTIMIZED PRINTED BALUN

(75) Inventor: Andy Dao, San Jose, CA (US)

(73) Assignee: Atheros Communications, Inc., Sunnyvale, CA (US)

( * ) Notice: Subject to any disclaimer, the term of this patent is extended or adjusted under 35 U.S.C. 154(b) by 0 days.

(21) Appl. No.: 09/522,116

(22) Filed: Mar. 9, 2000

(51) Int. Cl.[7] ..... H01P 5/10
(52) U.S. Cl. ..... 333/26
(58) Field of Search ..... 333/25, 26

(56) References Cited

U.S. PATENT DOCUMENTS 6,150,897 A * 11/2000 Nishikawa ..... 333/26

* cited by examiner

*Primary Examiner*—Justin P. Bettendorf
*Assistant Examiner*—Dean Takaoka
(74) *Attorney, Agent, or Firm*—Pillsbury Winthrop LLP

(57) ABSTRACT

A printed balun satisfies performance requirements for operation at a desired operational frequency (e.g., $f$=5.3 GHz) while minimizing space requirements on a circuit board. Segments of microstrip are connected at right angles that define fingers whose dimensions can be tailored for operation at a desired operational frequency while minimizing the corresponding space required on a circuit board. Minimal separation between the fingers avoids undesirable internal interference. Mounted at the edges of distinct fingers are the necessary ports for operation of the balun including a single-ended port, an isolation port, and two differential ports.

19 Claims, 4 Drawing Sheets

SPACE-OPTIMIZED PRINTED BALUN

BACKGROUND OF THE INVENTION

1. Field of Invention

The present invention relates to a device for balanced-to-unbalanced line transformation (balun) and more particularly to a space-optimized balun that can be printed on a circuit board.

2. Description of Related Art

A balun is a device used to convert between balanced and unbalanced lines for input and output in an electrical system. Special considerations apply to the application of a balun to microwave systems that include printed circuit boards. As is commonly known in the art, FIG. 7 illustrates a ring or "ratrace" design that is used in printed circuit boards. The ring balun 72 is made from microstrip line 74, including a conductive material such as copper. (*Microwave Circuit Design*, G. D. Vendelin, A. M. Pavio, and U. L. Rohde, John Wiley and Sons, 1990).

For the unbalanced line the ring balun 72 includes a single-ended port 76 and an isolation port 78. For the balanced line the ring balun 72 includes a first differential port 80 and a second differential port 82.

The distances along the microstrip 72 between the ports is related to the operational wavelength $\lambda$. As shown in FIG. 7 in a clockwise direction, the distance (measured circumferentially) between the single-ended port 76 and the first differential port 80 is $\lambda/4$, the distance between the first differential port 80 and the isolation port 78 is $\lambda/4$, the distance between the isolation port 78 and the second differential port 82 is $\lambda/4$, and the distance between the second differential port 82 and the single-ended port 76 is $3\lambda/4$. In typical operation, the single-ended port 76 is driven by a signal at an operational frequency $f$ and a 50 Ω resistor is attached to the isolation port 78. Then a differential signal is obtained from difference of the outputs at the first differential port 80 and the second differential port 82.

For the ring balun 72 the operational wavelength $\lambda$ is related to the operational frequency $f$ through the relation $$\lambda = \frac{c}{f\sqrt{\varepsilon_r}} \tag{1}$$

where c is the speed of light and $\epsilon_r$ is a substrate dielectric constant associated with the microstrip 74. Typically the operational frequency $f$ is fixed by the application and there is only limited choice for the properties of the microstrip 74.

For example, for the case where $f$=5.3 GHz and $\epsilon_r$=3.38 (e.g., for Rogers material RO4003®, then the circumferential distance between the single-ended port and the open ended port is approximately $\lambda/4$=350 mils. The ring balun 72 then approximately has a diameter of 668 mils and covers an area of 0.35 inch$^2$. This balun 72 can be approximately contained within a square having a side of length 668 mils and having an area of 0.45 inch$^2$.

The desirability of reducing the space occupied by elements on circuit boards has led to limited attempts to reduce the space occupied by the ring balun 72 by some modification of the geometry while keeping the essential features of the design. A difficulty with modifying the geometry of the ring balun 72 may arise due to interference (or coupling) between segments of microstrip that are relatively close together. This interference may adversely affect performance of the balun.

For example, FIG. 8 shows a modified ring balun 84 also made from microstrip line 86 and also having a single-ended port 88, an isolation port 90, a first differential port 92 and a second differential port 94. The circumferentially measured distances between the ports (88, 90, 92, 94) for the modified ring balun 84 are prescribed in terms of the wavelength $\lambda$ as in the ring balun 72. However, the arc between the first differential port 92 and the second differential port 94 is inverted, thereby saving some space on the circuit board while causing minimal interference near the cusps formed at the first differential port 92 and the second differential port 94. However, this improvement is minimal since the approximate area of a square that contains the modified balun 84 is still 0.447 inch$^2$.

Thus, the requirements for the space taken by a printed balun on a circuit board are driven in part by the desired operational frequency and the physical properties of the microstrip. Attempts to modify the conventional ring balun design have led to limited improvements in minimizing the required area on a circuit board.

SUMMARY OF THE INVENTION

Accordingly, it is an object of this invention to provide a balun that can be printed on a circuit board to optimize the covered space.

It is a further object of this invention to provide a printed balun that is designed to perform at a prescribed operating frequency including microwave frequencies.

It is a further object of this invention to provide a printed balun that satisfies performance criteria for signal attenuation and return loss.

The above and related objects of the present invention are realized by a balun that satisfies performance requirements while minimizing the corresponding area required on a circuit board.

According to one aspect of the invention, the balun includes a single-ended port, an isolation port, a first differential port, a second differential port, and a microstrip. The microstrip defines a plurality of fingers including a first finger that connects to the single ended port, a second finger that connects to the isolation port, a third finger that connects to the first differential port, and a fourth finger that connects to the second differential port.

The microstrip may also define a central segment that is transverse to the fingers and thereby connects them. Preferably the angles formed by the microstrip are approximately ninety degrees so as to minimize the overall space required by the balun by allowing uniform separations between segments of the microstrip. The lengths of the segments can be tuned to operate adequately at desired frequencies such as 5.3 GHz and 4.2 GHz.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, where.

DETAILED DESCRIPTION OF THE PRESENTLY PREFERRED EXEMPLARY EMBODIMENTS

Figure 1:
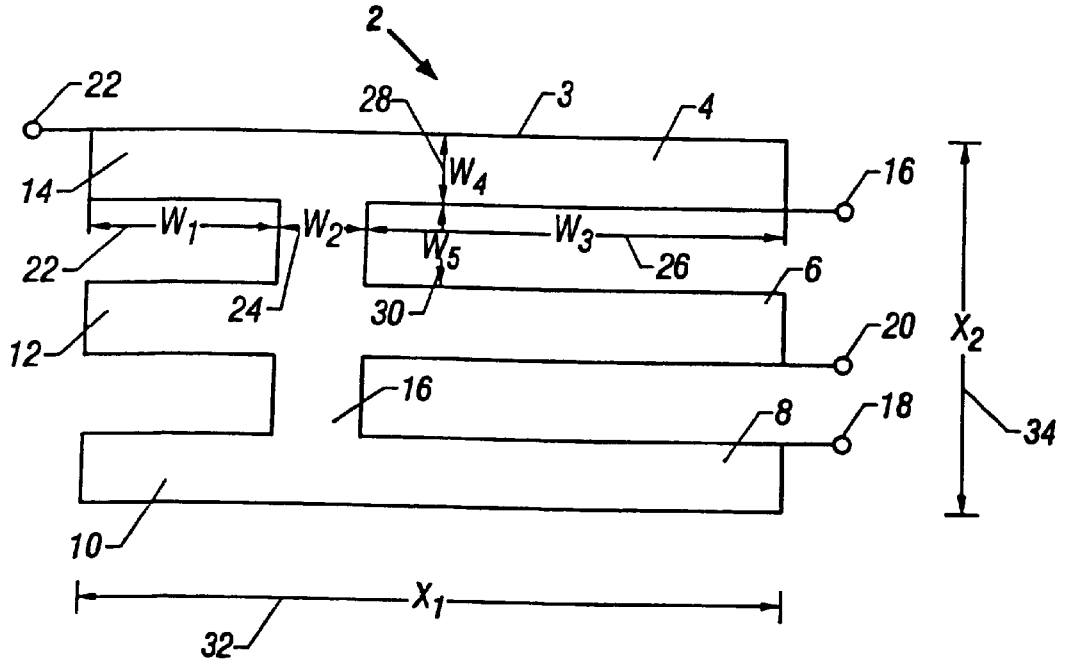
FIG. 1 is a diagram of a preferred embodiment of the invention.

A preferred embodiment of a printed balun 2 according to the present invention is illustrated in FIG. 1. A microstrip 3 defines a first finger 4, a second finger 6, a third finger 8, a fourth finger 10, a fifth finger 12, and a sixth finger 14. Angles formed by the microstrip 3 are all right angles. Additionally the microstrip defines a central segment 16 that links the fingers transversely. A single ended port 22 is disposed on an upper left portion of the sixth finger 14, and a complementary isolation port 20 is disposed on a middle right portion of the second finger 6. A first differential port 17 is disposed on a lower right portion of the first finger 4, and a second differential port 18 is disposed on a lower right portion of the first finger 4. In the preferred embodiment the balun 2 is printed on a circuit board.

The lengths of the leftmost fingers (10, 12, 14) are equal and denoted by $w_1$ 22. The width of the central segment is denoted by $w_2$ 24. The lengths of the rightmost fingers (4, 6, 8) are equal and denoted by $w_3$ 26. The widths of the fingers (4, 6, 8, 10, 12, 14) are equal and denoted by $w_4$ 28. The separations between laterally adjacent fingers (4 and 6, 6 and 8, 10 and 12, 12 and 14) are equal and denoted by $w_5$ 30. An overall length of the balun 2 is given by $x_1$ 32, where $x_1=w_1+w_2+w_3$. An overall width of the balun is given by $x_2$ 34 where $x_2=3w_4+2w_5$.

Figure 7:
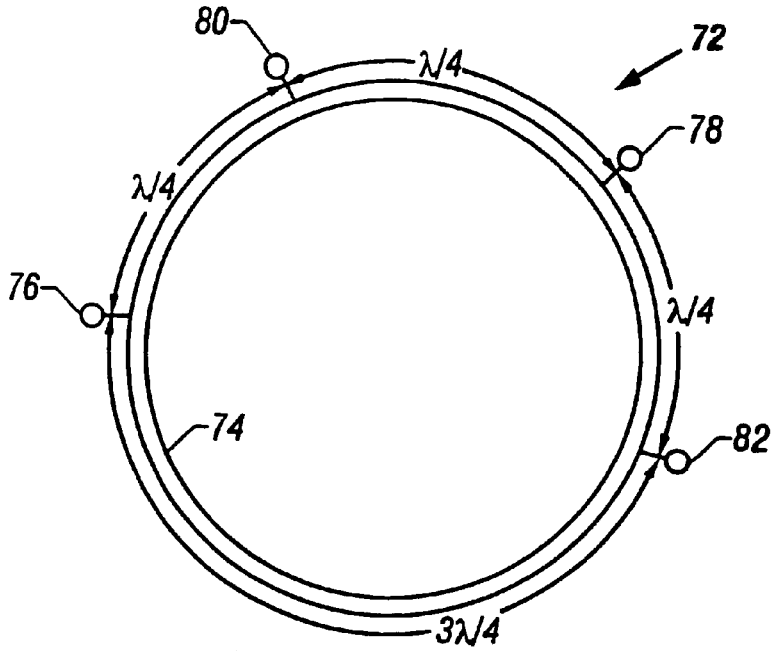
FIG. 7 (Prior Art)
FIG. 7 is a diagram of a ring balun from the prior art.
Figure 8:
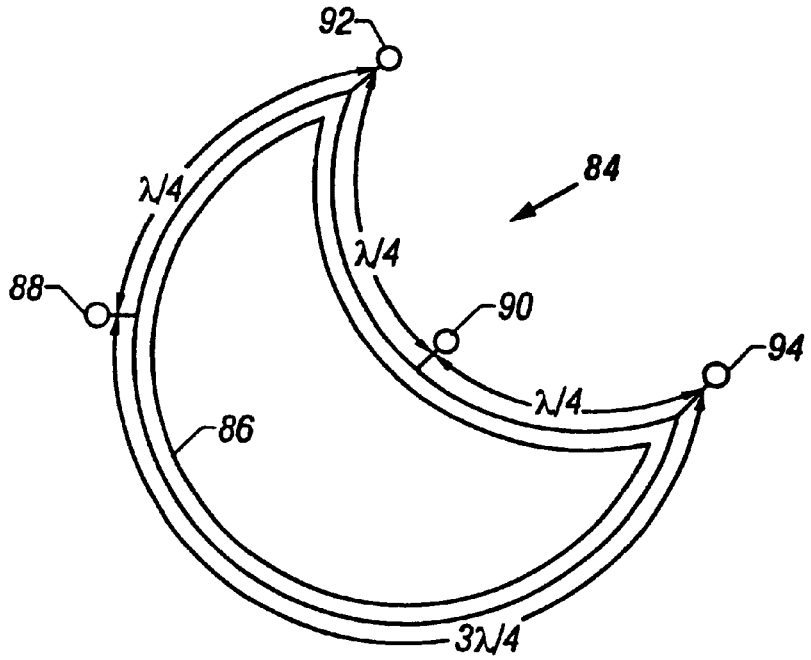
FIG. 8 (Prior Art)
FIG. 8 is a diagram of a modification of the ring balun of FIG. 7.

In the prior art balun 72 of FIG. 7, the distances between the ports (76, 78, 80, 82) are determined in terms of the operational wavelength that is determined by the operational frequency f through equation (1). According to the present invention, the relative distances measured along the microstrip between the ports (16, 18, 20, 22) are similarly related but with a different scaling characterized by the operational wavelength $\lambda_1$. Then, as measured along the microstrip 3, the distance between the single-ended port 22 and the first differential port 17 is $\lambda_1/4$, the distance between the first differential port 17 and the isolation port 20 is $\lambda_1/4$, the distance between the isolation port 20 and the second differential port 18 is $\lambda_1/4$, and the distance between the second differential port 18 and the single-ended port 22 is $3\lambda_1/4$. In terms of the length parameters defined above, this leads to three constraint equations:

$$w_1+w_2+w_3+w_4=\lambda_1/4 \quad (2)$$

$$2w_3+(3/2)w_5=\lambda_1/4 \quad (3)$$

$$5w_1+w_2+w_3+4w_4+2w_5=3\lambda_1/4. \quad (4)$$

Some design parameters can be set by operational requirements for guaranteeing adequate spacing between adjacent lines of microstrip 3 so as to avoid electrical interference. Because the angles of the balun 2 are all right angles spacing requirements may be easily imposed in terms of the design parameters. The finger width parameter $w_4$ and the finger separation parameter $w_5$ may be set to avoid electrical interference between parallel lines of the microstrip. For example, under nominal operating conditions, an acceptable separation between lines of microstrip in a printed balun is 80 mils. Then, in the preferred embodiment the finger width parameter $w_4$ and the finger separation parameter $w_5$ are set as w4=w5=80 mils. Then the system of three equations given by equations (1), (2), and (3) can be re-written as:

$$w_1+w_2+w_3=\lambda_1/4-w_4 \quad (5)$$

$$2w_3=\lambda_1/4-(3/2)w_5 \quad (6)$$

$$5w_1+w_2+w_3=3\lambda_1/4-4w_4-2w_5. \quad (7)$$

When $\lambda_1$ is known, the right-hand sides of equations (5), (6), and (7) are then known, and the values for $w_1$, $w_2$, and $w_3$ are thereby determined from the solution of this linear system of three equations.

Determining $\lambda_1$ for a given operational frequency $f$ can be accomplished computationally by a relaxation process that is initiated from the operational wavelength $\lambda$ for the ring balun 72 (i.e., equation (1)). In the preferred embodiment the microstrip used has an approximate substrate dielectric constant $\in_r=3.38$, the thickness is approximately 20 mils and the width is approximately 25 mils (e.g., Rogers material RO4003®). The prescribed operational frequency $f$ is set as $f$=5.3 GHz. Then from equation (1) one can calculate $\lambda/4$=350 mils (approximately).

In operation of the balun 2, the single-ended port 22 is driven by an input signal $I_0$ at the operational frequency $f$ and a 50 Ω resistor is attached to the isolation port 20. An output signal $S_1$ results at the first differential port 16 and an output signal $S_2$ results at the second differential port 18. Ideally these two output signals have equal amplitudes and phases shifted by 180 degrees. Let $\Delta_{amp}$ be the amplitude difference and let $\Delta_{phase}$ be the phase difference so that these quantities can be used to diagnose the performance of the balun 2 at the prescribed operational frequency $f$=5.3 GHz.

As is well-known in the art, the differential output signals $S_1$ and $S_2$ under these operational conditions can be simulated in software.

Figure 2:
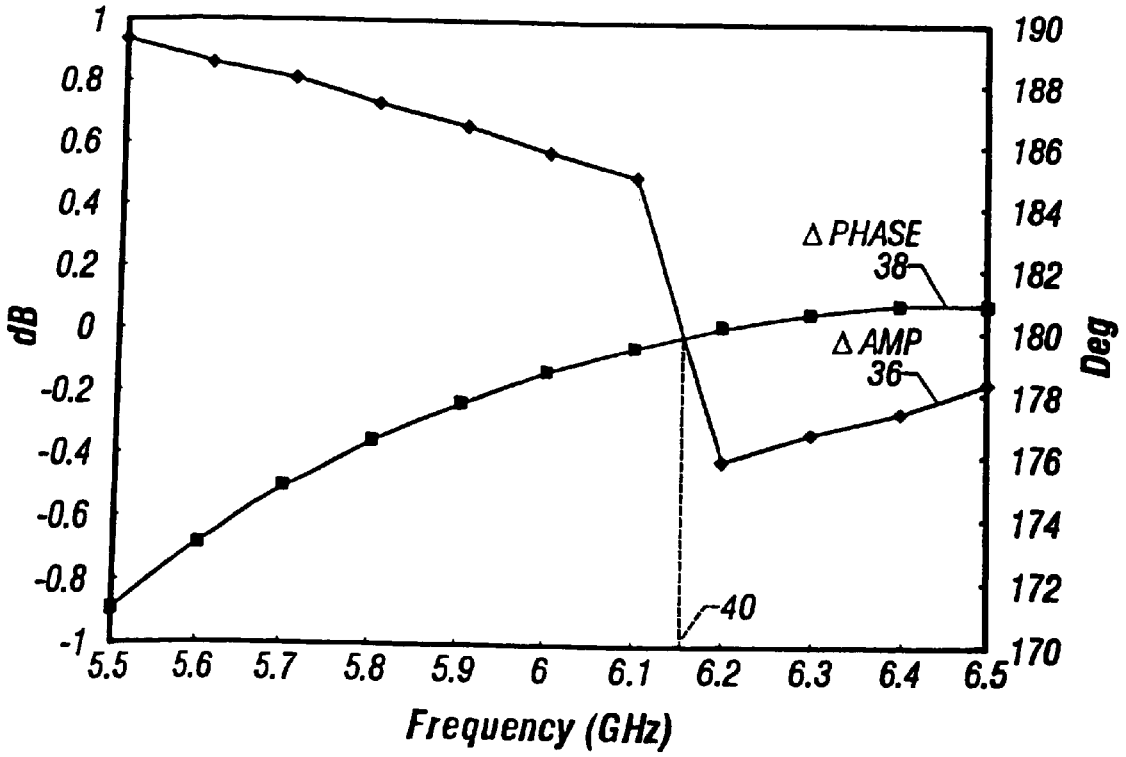
FIG. 2 is graph illustrating the initiation of the design process for the invention.

The graph in FIG. 2 shows the performance of the balun 2 for frequencies between 5.5 GHz and 6.5 GHz_when the dimensions of the balun 2 are determined by from the dimensions of the ring balun 72. That is, from equation (1) the value $\lambda/4$=350 mils is obtained from $\epsilon_r$=40.5 and $f$=5.3 GHz. The corresponding dimensions of the balun 2 are then determined from the equations (5), (6), and (7) with $\lambda_1/4$=350 (and $w_4=w_5$=80 mils). FIG. 2 shows that with these dimentions the balun 2 does not perform adequately around $f$=5.5 GHz. While the plots for $f$=5.3 GHz are not shown it should be appreciated from the slopes of the curves in FIG. 2 that the performance is worse than the performance at 5.5 GHz. The values for $\Delta_{amp}$ 36 and $\Delta_{phase}$ 38 achieve a crossover value 40 in the neighborhood of $f$=6.2 GHz where each of these diagnostic measures is acceptably small. Under nominal conditions, one might require that $|\Delta_{amp}|<0.3$ Db and $|\Delta_{phase}-180°|<2°$. Thus, the design illustrated in FIG. 2 is acceptable for operation at $f$=6.2 GHz but not at $f$=5.5 GHz and below.

Figure 3:
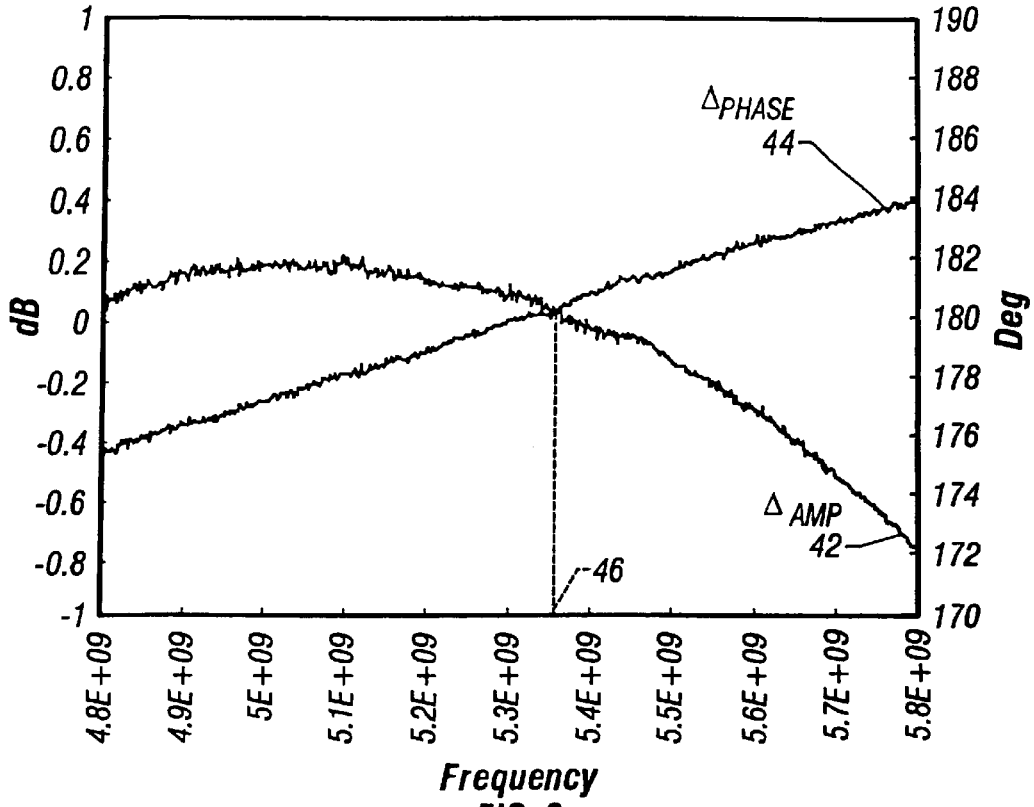
FIG. 3 is a graph illustrating performance characteristics relating to amplitude differences and phase differences at the differential ports for the invention.

A relaxation of the parameter $\lambda_1$ allows for a stable adjustment in the performance curves. The graph in FIG. 3 shows the performance of the balun 2 for $\lambda_1/4$=430 mils. The values for $\Delta_{amp}$ 42 and $\Delta_{phase}$ 44 achieve a crossover value 46 in the neighborhood of $f$=5.3 GHz where each of these diagnostic measures is acceptably small (i.e., $|\Delta_{amp}|<0.3$ Db and $|\Delta_{phase}-180°|<2°$). Thus, the design illustrated in FIG. 3 is acceptable for operation at $f$=5.3 GHz. The complete physical dimensions of the balun 2 are now determined from the equations (5), (6), and (7) with $\lambda_1/4=430$ (and w4=w5=80 mils), whereby one determines (approximately) $w_1=115$ mils, $w_2=80$ mils, and $w_3=155$ mils. Then the overall linear dimensions (32, 34) of the balun 2 are approximately given by $x_1=350$ mils and $x_2=400$ mils so that the balun 2 covers a rectangular area of approximately 0.14 inch$^2$.

These dimensions underscore advantages of the balun 2 of the present invention with $\lambda_1/4=430$ compared with the ring balun 72 with $\lambda/4=350$, where both of these devices are designed to operate at the frequency $f=5.3$ GHz. The ring balun 72 approximately has an area of 0.35 inch$^2$ and can be contained within a square of area 0.45 inch$^2$.

Figure 4:
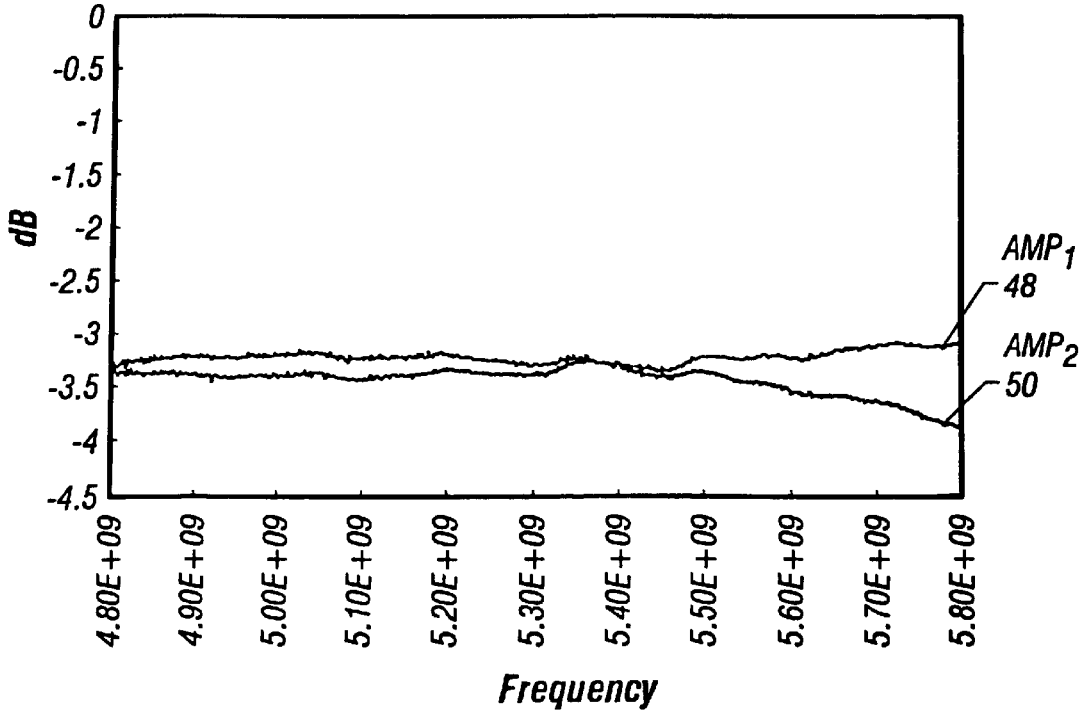
FIG. 4 is a is a graph illustrating performance characteristics relating to amplitudes at the differential ports for the invention.
Figure 5:
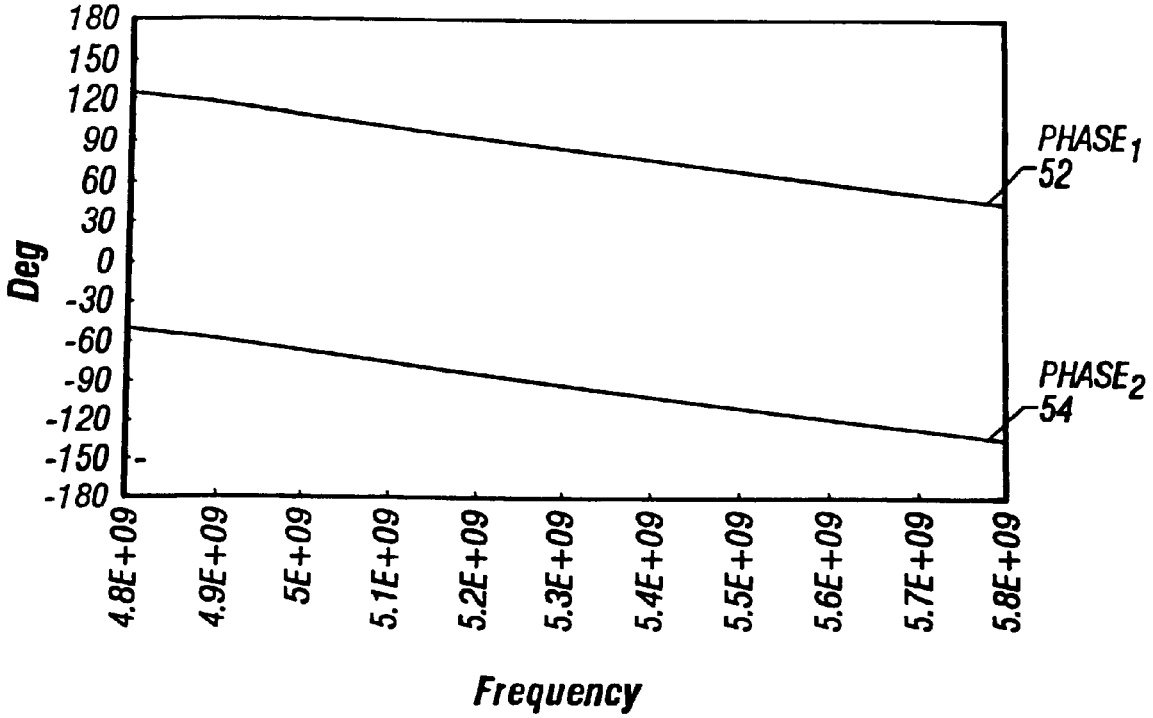
FIG. 5 is a is a graph illustrating phase values at the differential ports for the invention.

In addition to substantially reducing the requirements for space on a printed circuit board, the balun 2 of the present invention also satisfies desirable performance conditions in addition to those illustrated in FIG. 3 (i.e., $|\Delta_{amp}|<0.3$ Db and $|\Delta_{phase}-180°|<2°$). FIG. 4 shows the corresponding curves for the amplitude of $S_1$, denoted as $Amp_1$ 48 and the amplitude of $S_2$, denoted as $Amp_2$ 50, where the amplitudes are measured relative to the amplitude of the input signal $I_0$ at the single-ended port 22 in order to characterize signal attenuation in the balun 2. In a neighborhood of the operating frequency $f=5.3$ GHz, the amplitude losses are comparable to the losses associated with the ring balun 72 (i.e., −3.3 to −3.5 dB). FIG. 5 shows the corresponding curves for the phase of $S_1$, denoted as $Phase_1$ 52 and the phase of $S_2$, denoted as $Phase_2$ 54.

Figure 6:
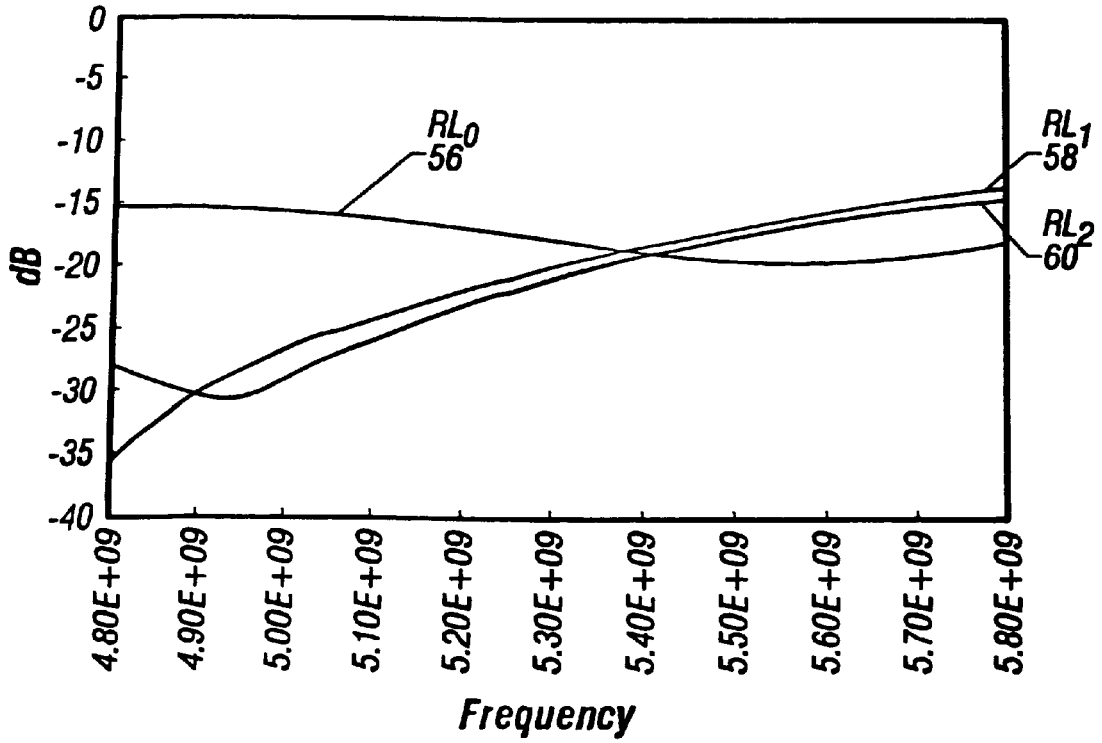
FIG. 6 is a graph illustrating performance characteristics relating to return losses at the single-ended port and the differential ports for the invention.

Return loss is also a criterion for measuring the quality of a balun. For example, return loss can be characterized by the formula $$RL = 10\log\left(\frac{PR}{PA}\right)^2$$

where RL denotes return loss as determined by reflected power PR and absorbed power PA. FIG. 6 shows corresponding return loss curves at the single-ended port 22, denoted as $RL_0$ 56, at the first differential port 16, denoted as $RL_1$ 58, and at the second differential port 18, denoted as $RL_2$ 60. Under nominal conditions, a return loss below −15 dB is considered desirable, and thus, according to FIG. 6, the balun 2 satisfies this criterion in a neighborhood of the operating frequency $f=5.3$ GHz.

The preferred embodiment illustrated in FIGS. 1, 3–6 for the operating frequency $f=5.3$ GHz. satisfies accepted performance criteria for a printed balun while substantially reducing the corresponding space required on a printed circuit board. The flexible design process easily can be extended to other operating frequencies. For example, for the operating frequency $f=4.2$ GHz, the relaxation process described above leads to an acceptable operational wavelength with $\lambda_1/4=520$ mils so that solving equations (5), (6), and (7) with $\lambda_1/4=520$ mils and $w_4=w_5=80$ mils determines the other dimensional parameters as $w_1=160$ mils, $w_2=80$ mils, and $w_3=200$ mils.

More generally, a specification of the operating frequency $f$ leads to a determination of an acceptable operational wavelength $\lambda_1$ by the relaxation method discussed above with respect to FIGS. 2 and 3. Then for the geometry of the balun 2 shown in FIG. 1, equations (2), (3), and (4) can be solved for the dimensional design parameters $w_1$, $w_2$, $w_3$, $w_4$, $w_5$, subject to additional constraints (e.g., minimal spacing between microstrip segments to avoid interference).

The geometry of the balun 2 shown in FIG. 1, advantageously uses a design with six fingers 4, 6, 8, 10, 12, 14, defined by right angles in the microstrip 3. The number of fingers may be varied to create other balun designs suitable for minimizing area on a printed circuit board while maintaining the necessary separation between the ports. Additionally, although the use of right angles advantageously allows the microstrip to be placed compactly while avoiding internal interference, this design feature may also be relaxed.

Although only certain exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A balun, comprising:

a single-ended port;

an isolation port;

a first differential port;

a second differential port;

a microstrip, wherein the microstrip defines a plurality of fingers including a first finger that connects to the single ended port, a second finger that connects to the isolation port, a third finger that connects to the first differential port, and a fourth finger that connects to the second differential port.

2. A balun, as claimed in claim 1, wherein angles formed by the microstrip are approximately ninety degrees.

3. A balun, as claimed in claim 2, wherein the microstrip defines a central segment that is transverse to the fingers.

4. A balun as claimed in claim 3, wherein the balun operates at a frequency of approximately 5.3 GHz.

5. A balun, as claimed in claim 1, wherein the microstrip includes copper.

6. A balun as claimed in claim 1, wherein the balun operates at a frequency of approximately 5.3 GHz.

7. A balun as claimed in claim 1, wherein the balun operates at a frequency of approximately 4.2 GHz.

8. A balun, comprising:

a single-ended port;

an isolation port;

a first differential port;

a second differential port;

a microstrip, wherein the microstrip defines a plurality of fingers including a first finger that connects to the single ended port, a second finger that connects to the isolation port, a third finger that connects to the first differential port, and a fourth finger that connects to the second differential port, and the microstrip defines a central segment transverse to the plurality of fingers and which couples the plurality of fingers to each other;

a clockwise distance along the microstrip from the single-ended port to the first differential port is approximately equal to a clockwise distance along the microstrip from the first differential port to the isolation port the clockwise distance along the microstrip from the single-ended port to the first differential port is approximately equal to a clockwise distance along the microstrip from the isolation port to the second differential port; and the clockwise distance along the microstrip from the single-ended port to the first differential port is approximately equal to one-third of a clockwise distance along the microstrip from the second differential port to the single-ended port.

9. A balun, as claimed in claim 8, wherein angles formed by the microstrip are approximately ninety degrees.

10. A balun, as claimed in claim 9, wherein the microstrip defines a central segment that is transverse to the fingers.

11. A balun as claimed in claim 10, wherein the balun operates at a frequency of approximately 5.3 GHz.

12. A balun, as claimed in claim 8, wherein the microstrip includes copper.

13. A balun as claimed in claim 8, wherein the balun operates at a frequency of approximately 5.3 GHz.

14. A balun as claimed in claim 8, wherein the balun operates at a frequency of approximately 4.2 GHz.

15. A method for designing a printed balun, comprising:

determining a geometry of the balun, the geometry depending on a plurality of design parameters and including a microstrip defining a plurality of fingers;

wherein the plurality of fingers include a first finger that connects to a single ended port, a second finger that connects to a isolation port, a third finger that connects to a first differential port, and a fourth finger that connects to a second differential port;

determining materials of the balun, the materials being characterized by material parameters;

determining positions on the balun for the single-ended port, the isolation port, the first differential port, and the second differential port;

choosing an operating frequency for the balun;

determining values for the design parameters for acceptable performance of the balun at the operating frequency.

16. The method of claim 15, wherein determining design parameters comprises:

setting constraints on the design parameters, the constraints including constraints based on the operating frequency, the material parameters, and the positions for the single-ended port the isolation port the first differential port and the second differential port; and finding values for the design parameters that satisfy the constraints on the design parameters.

17. The method of claim 16, wherein setting constraints on the design parameters further comprises:

simulating performance of the balun based on the values for the design parameters.

18. The method of claim 17, wherein simulating performance of the balun comprises evaluating amplitude differences and phase differences at the first differential output port and the second differential output port.

19. The method of claim 18, wherein simulating performance of the balun further comprises evaluating return losses at the single-ended port, the first differential port and the second differential port.

* * * * *